US008808462B2

(12) United States Patent
Rieger et al.

(10) Patent No.: US 8,808,462 B2
(45) Date of Patent: Aug. 19, 2014

(54) DISHWASHER WITH A LOW-MAINTENANCE FILTER SYSTEM

(75) Inventors: Roland Rieger, Rainau (DE); Franz-Josef Wagner, Noerdlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1759 days.

(21) Appl. No.: 11/791,904

(22) PCT Filed: Oct. 20, 2005

(86) PCT No.: PCT/EP2005/055423

§ 371 (c)(1),
(2), (4) Date: May 29, 2007

(87) PCT Pub. No.: WO2006/063894

PCT Pub. Date: Jun. 22, 2006

(65) Prior Publication Data

US 2008/0116135 A1 May 22, 2008

(30) Foreign Application Priority Data

Dec. 17, 2004 (DE) ..... 10 2004 060 950

(51) Int. Cl.
*B08B 9/20* (2006.01)
*A47L 15/42* (2006.01)

(52) U.S. Cl.
CPC ..... *A47L 15/4208* (2013.01); *A47L 15/4206* (2013.01)
USPC ..... 134/25.2; 134/111

(58) Field of Classification Search
USPC ..... 134/10, 56 D, 57 D, 58 D, 104.1, 111, 134/104.4
See application file for complete search history.

(56) References Cited

U.S. PATENT DOCUMENTS

| | | | |
|---|---|---|---|
| 5,770,058 | A | 6/1998 | Jozwiak |
| 2004/0003833 | A1 | 1/2004 | Elick et al. |
| 2004/0007253 | A1 * | 1/2004 | Jung et al. ..... 134/10 |

FOREIGN PATENT DOCUMENTS

| | | |
|---|---|---|
| DE | 41 31 914 | 4/1993 |
| EP | 1 256 308 | 11/2002 |
| EP | 1 386 575 | 2/2004 |

OTHER PUBLICATIONS

Machine Translation of Kaefferlein (DE 4131914), Apr. 1993.*
International Search Report PCT/EP2005/055423.

* cited by examiner

*Primary Examiner* — David Cormier
(74) *Attorney, Agent, or Firm* — James E. Howard; Andre Pallapies

(57) ABSTRACT

A dishwasher with a multi-step filter system includes a coarse filter and a micro filter for cleaning the rinsing solution and also includes a lye pump and a circulatory pump. The dishwasher also includes a comminutor arranged in the path of the flow downstream from the coarse filter for remains contained in the rinsing solution.

18 Claims, 2 Drawing Sheets

DISHWASHER WITH A LOW-MAINTENANCE FILTER SYSTEM

Figure 1:
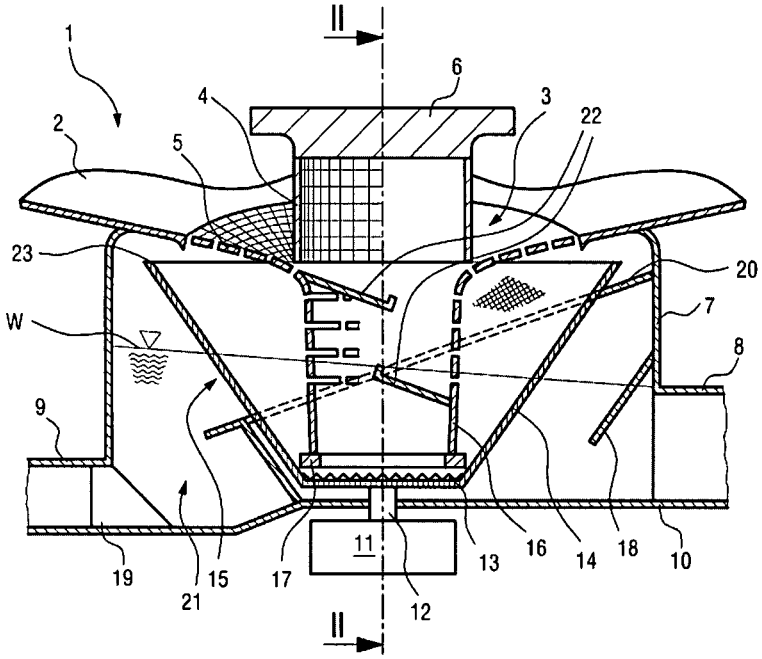

The invention relates to a dishwasher comprising a washing container with devices for loading items to be washed with rinsing liquor, a filter system with at least one filter for cleaning the rinsing liquor, a comminutor, a lye pump and a circulating pump, and two methods for cleaning rinsing liquor in this system, in which the filtered water is fed back to the rinsing circuit.

Filter systems of dishwashers of prior art have previously been provided with three or four steps.

A fine filter, which constitutes most of the bottom surface of an interior of a dishwasher, forms a flat funnel with slightly inclined lateral walls in whose centre are arranged a coarse filter, if necessary a fine filter and a micro filter. A fine filter is only installed between the coarse filter and micro filter in the four-step filter system. The dirty water is therefore fed either through the flat fine filter or, if it cannot penetrate pass through the fine filter due to a high dirt load, is filtered by the coarse filter, any fine filter intermediately installed, and finally by the micro filter. The flat fine filter and the coarse to micro filter are therefore arranged in parallel. The water therefore runs in the three-step system through a maximum of two, and in the four-step system through a maximum of three filters. Residues which do not pass through the coarse filter remain in front of it and therefore lie within the field of vision of the operator on the bottom surface. On the other hand, dirt which passes through the coarse filter accumulates in front of the fine and micro filters. There it must be removed by the user of the machine at regular intervals, otherwise the filtration will be inadequate due to blocked filter openings.

Furthermore, filter systems which permanently cleaning the filter system during the rinsing process, in which the filters are counter-rinsed and the filter residues pumped off, are known in particular from American rinsing machines. This method requires a higher volumetric flow.

U.S. Pat. No. 5,770,058 discloses a separating device for dishwashers. The rinsing liquor flows through an annular opening into the separating device either via a coarse filter or directly into a centrifuge. The rinsing liquor is fed to the spray devices by means of a pump rotor. The rinsing liquor is therefore cleaned either by the filter or by the centrifuge. The residues remaining in the separating device are comminuted when the rinsing liquor is pumped off in another direction of flow.

In contrast to this the object of the invention is to indicate a low maintenance dishwasher whose filter system is largely self-cleaning without counter-rinsing.

This object is achieved in the dishwasher already mentioned in that a micro filter is arranged in the path of the flow downstream of the comminutor.

Resides which are processed by the comminutor are understood essentially to mean remains of food which reach the dishwasher with the dishes and crockery to be cleaned. This also includes further particles such as matches, tooth picks, packing remains or the like which are deposited, for example, on the edge of a plate. If they are retained by a filter they form the filtered material and the filter residue of the filter in question.

The invention does not therefore relate to a filter system which has to be regularly maintained by the user at variable cost, because it only collects and deposits the filtered material. Instead the invention follows the principle of continuously cleaning the consumed rinsing liquor, comminuting and pumping off filter residues and returning cleaned rinsing liquor to the water circuit. All these processes take place in parallel with each other.

"Parallel" is understood on the one hand to mean "simultaneous". Therefore, whereas as rinsing liquor is cleaned by filters, for example, and fed to the rinsing liquor circuit, filter residues are simultaneously comminuted and collected. However, the processes may take place in parallel insofar as the rinsing liquor flow is divided into at least two parallel paths which are treated separately. The invention therefore enables all the operating steps of the dishwasher to be integrated in a single direction of flow of the water in the dishwasher. Therefore no intermediate step or even a reversal of flow direction takes place that would interrupt the operating process of the dishwasher or delay the immediate follow-on of a further cleaning programme. This ensures high efficiency of the dishwasher.

Although coarse filtered material remains as before, which does not even pass through the coarse filter, untreated, and must be removed by the operator, it remains visible to the operator inside the dishwasher, so that cleaning must be carried out by him. This material includes only those food remains and the like which have not inadvertently been removed before the dishwasher is loaded. All other remains which have previously been deposited invisibly inside the filter system, and whose removal has therefore frequently been forgotten, are now chopped up in the comminutor so that they can be pumped off by a lye pump.

The comminution of the material passing through the coarse filter is appropriate, for example, if the contaminated rinsing liquor has previously been fed through a fine filter. In other words the comminuted material is therefore the filtered residue of the fine filter. Moreover, care must be taken to ensure that the filter residue of the micro filter is also removed so that the filter is not blocked. Sine the micro filter is generally downstream of the coarse and/or fine filter, it is generally extremely difficult to access. Mechanical mechanisms are preferably chosen for cleaning the micro filter. According to the invention the principle of a centrifuge is used for this purpose. For according to an advantageous design of the invention the micro filter forms, at least in part, a surface area of a centrifuge for centrifuging the rinsing liquor, the surface area of the centrifuge expanding conically to form an ejection opening. Filter material which does not pass through the micro filter because of its size, is conveyed away from the surface of the micro filter because of the centrifugal force and the conical surface area, and ejected through the ejection opening. On the other hand, the water is forced through the micro filter due to the centrifugal force. The micro filter is therefore given a higher cleaning power because on the one hand the passage of water through the micro filter is accelerated, and on the other hand the filter area of filter residues is continuously freed and is therefore immediately available again for further filter processes.

The filter material ejected from the centrifuge must be collected immediately and removed if possible. Advantageously a scoop, designed so that it collects the filter material that reaches a point beyond one edge of the centrifuge due to centrifugal force, is assigned to the ejection opening of the centrifuge. It is collected by means of the scoop and fed together with the omnipresent water to the lye pump. This causes the filter material and water, which is able to penetrate the micro filter, to be separated effectively from each other.

In principle the coarse filter and comminutor on the one hand and the centrifuge on the other can be arranged parallel with each other in the path of flow of the dishwasher. A particularly advantageous arrangement is provided, however, if the comminutor is arranged in the path of flow between the coarse filter and the centrifuge. The filter passage of the coarse filter may then be subjected to further cleaning. The water cleaned in it, which has previously been fed to the lye pump, can now be fed back into the rinsing liquor circuit. The recycling rate of the rinsing liquor therefore increases and with it the amount of water saved in the operation of the dishwasher.

A spatial arrangement of the coarse filter, comminutor and centrifuge above each other has the advantage that the dirty rinsing liquor is conveyed from the coarse filter into the comminutor without any outside influence, following only the force of gravity. If the coarse filter and comminutor are also arranged concentrically to each other and jointly concentrically to the centrifuge, this gives rise to a particularly compact design which is desirable because of the fined space in the dishwasher. Moreover, the comminutor and the centrifuge can then be driven by the same shaft, thus simplifying design. This also increases the compactness of the filter system.

The efficiency of a filter system is measured by the throughput of the dirty rinsing liquor per unit of time. The throughput is in turn dependent on the pipe cross-section of the structural units through which the dirty rinsing liquor must pass. A bottleneck in any filter system may be formed by the filter surfaces because they are reduce their area of passage by transfer or blocking with filter material if they are not cleaned mechanically, for example. The feed opening of the centrifuge may form another bottleneck. In an advantageous further development of the invention this is counteracted in that the ejection opening of the centrifuge combines with the feed opening to form a functional unit so that it serves at the same time as its common feed opening. In this case the filter material is ejected from the centrifuge on the edge of the opening, whilst at the same time the centrifuge can be fed in the central region of the opening. The opening is any case designed to be large enough for both functions because the centrifuge widens conically towards the opening. Moreover, because the ejection and feed openings are arranged on the side of the centrifuge facing the interior of the dishwasher, the water to be cleaned only reaches the interior of the centrifuge driven by the force of gravity. At the same time the centrifuge therefore offers a maximum admission cross-section, thereby maximising its efficiency.

A filter of at least the same size as the feed opening is also advantageously installed upstream of the opening and is arranged coaxially to the centrifuge. It is essential that in a centric view of the feed opening of the centrifuge it is covered completely by the filter. However, it does not seal the feed opening because it serves as an ejection opening at the same time. A gap remains between the filter and the feed opening as a passage for the filter residue of the centrifuge. This enables the rinsing liquor to be fed by the shortest route through the filter and into the centrifuge.

If a fine filter is chosen as the covering filter, its mesh width must then be dimensioned so that the filter passage need no longer be processed by the comminutor for it to be drained by the lye pump. The dirty water which passes through the fine filter can then be fed immediately to the centrifuge, bypassing the comminutor.

According to a further advantageous design of the invention a frictional surface is formed on a bottom surface opposite the ejection openings of the centrifuge. Together with a fixed stop it acts as a comminutor, preferably at the lower end of a container-shaped section of the coarse filter projecting into the centrifuge. The stop may be annular in shape and form the lower termination of the container-shaped section. It may also have one or a plurality of ribs which extend in the plane of the lower termination of the container-shaped section essentially along its diameter. The entire frictional surface is fitted with teeth which project into a narrow gap defined by the stop and the frictional surface together. The filter residues of the coarse filter are crushed on the rapidly rotating frictional surface, in the manner of a vegetable juice press, in the gap between the frictional surface and the stop, and are forced by centrifugal force into the centrifuge through an annular gap between the annular section of the stop and the frictional surface. The presence of water facilitates this process by softening the filter residues, but is not absolutely necessary. The design described provides an extremely compact structural unit comprising the centrifuge and comminutor. The comminution therefore advantageously takes place at the lowest and narrowest point of the conical centrifuge so that the comminuted filter material must take the longest route through the micro filter before it is ejected.

The comminution continues until a particle size is obtained which can still be handled by the lye pump. However, the possibility that objects which, although they have passed through the coarse and fine filters, cannot be pumped off by the lye pump, must not be ruled out. These include, in particular, long, thin objects, e.g. tooth picks. In order to safeguard proper operation of the lye pump a pump well, which is separated by a trap from the lye pump feed, is formed upstream of the lye pump according to a further advantageous design of the invention. Once again this provides a water filtration which prevents the function of the lye pump from being impaired.

Since the inventive filter system is not counter-rinsed, the trap must ensure that material deposited in front of it can be removed. An advantageous design of the invention therefore provides for an inspection flap giving access to the pump well. This allows simple, manual cleaning of the filter system upstream of the lye pump and downstream of the coarse filter, the fine filter and micro filter.

According to a further advantageous design of the invention a suction cap is arranged upstream of the circulating pump, which cap prevents the formation of a flow funnel in the rinsing liquor sucked in and cleaned. The suction cap ensures that the circulating pump does not suck air, thereby increasing the throughput and efficiency of the circulating pump.

The object is therefore achieved in the method already mentioned in that food remains and the like passing through the coarse filter are simultaneously comminuted and removed by a lye pump. In contrast to the state of the art, where the rinsing liquor is conducted through stationary three- or four-step filter systems, and in which the filters have to be cleaned either manually or by counter-rinsing, the method according to the invention follows the principle of comminuting essential elements of the filter material to such an extent that the material can be removed by the lye pump without damage. This renders cleaning of the filters of filter residues largely superfluous.

To allow continuous cleaning of the filters whilst at the same time returning the cleaned rinsing liquor, the filters must be cleaned. This can be done mechanically or chemically. An advantageous design of the invention therefore provides for the micro filter to be cleaned by centrifugal forces. It is therefore possible to clean the micro filter, in particular, without tools which could in turn cause wearing or damage to the micro filter. Chemical agents, which would again have to be removed from the rinsing liquor in a further step, may also be dispensed with.

Figure 2:
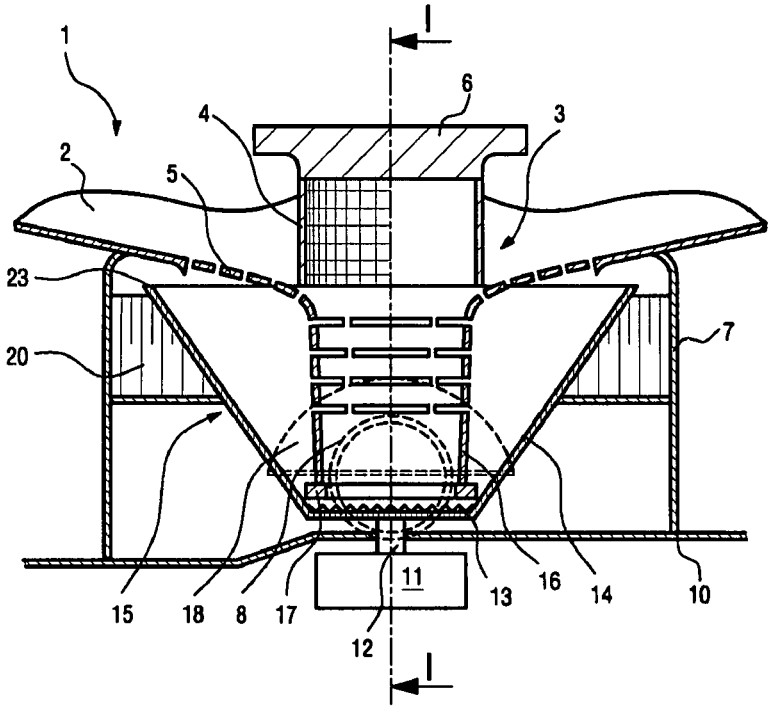

The invention is explained in greater detail by way of example with reference to drawings in which:

FIG. 1 shows a section through a filter system according to the invention, and FIG. 2 shows a section through the filter system perpendicular to the sectional view in FIG. 1.

FIG. 1 shows a sectional view of a self-cleaning filter system according to the invention. It is arranged essentially underneath a bottom plate 2, which forms the lower termination of an interior or washing container (not shown) of a dishwasher. It is funnel-shaped and has a very flat inclination to a central filter inlet 3. Filter inlet 3 is formed by a coarse filter 4 and a fine filter 5. Coarse filter 4 comprises on its upper side facing the interior of the dishwasher an annular rotating handle 6. Coarse filter 4 can be removed by means of handle 6. Filter inlet 3 forms the upper end face of a cylindrical pump head 7. A suction connection 8 of a circulating pump, not shown, and a suction connection 9 of a lye pump, not shown, are arranged opposite each other in the surface area of this head in a lower section. Under the end base 10 of pump head 7 is arranged a motor 11, which drives a friction disc 13 through a shaft 12. A surface area of a centrifuge 15, widening conically towards filter inlet 3, is arranged on friction disc 13. A container 16, which represents a conical extension of fine filter 5, projects from filter inlet 3 into centrifuge 15. Coarse filter 4, with handle 6, forms the upper termination of container 16. On its underside the surface area of container 16 opens into a stop ring 17, which is approximately the same size as friction disc 13.

Suction connection 8 of the circulating pump is covered over approximately half its diameter by a suction cap 18 projecting into pump head 7. It prevents a suction or flow funnel, causing air to be sucked in and hence reducing the efficiency of the circulating pump, during operation of the circulating pump.

Suction connection 9 of the lye pump is separated from pump head 7 by a trap 19. This prevents particles from entering the lye pump which are so large that the pump cannot process them. An inspection flap, not shown, is provided as the access for cleaning trap 19.

Centrifuge 15 is surrounded annularly by a discharge surface 20 which extends between micro filter 14 of centrifuge 15 and the inner surface of pump head 7 obliquely downwards from the side of the circulating pump in the direction of the lye pump, and there terminates in a pump well 21 in front of trap 19.

Container 16 contains two scoop ribs 22, which are arranged offset one above the other and overlap each other slightly. The upper of the two scoop ribs is inclined inwards from the surface area of container 16 to a central axis, and the lower rib is inclined outwards from the central axis to the surface area. For reasons of clarity they are not shown in FIG. 2. They serve to collect washing active solids, e.g. detergent tabs, so that they dissolve in the water flow, according to the regulations, and are able to take effect successively.

When filter system 1 is operating dirty rinsing liquor is fed either through the openings of fine filter 5 or through those of coarse filter 4 and into the interior of pump head 7. Coarse filter 4 and fine filter 5 together cover a feed opening of centrifuge 15, which is limited by an edge 23. Rinsing liquor which is fed through fine filter 5 enters centrifuge 15 directly, bypassing container 16. It need not be conducted via container 16 into the comminutor because the mesh width of fine filter 5 is designed so that particles which pass through fine filter 5 cannot be collected by trap 19 and discharged by the lye pump without impairing operation. Dirt particles which are not admitted by fine filter 5 are fed to coarse filter 4. The mesh width of coarse filter 4 is in turn selected so that particles which pass through coarse filter 4 can be processed by friction disc 13. Thus if particles pass through coarse filter 4 they fall by gravity through container 16, whose mesh width is equal to that of fine filter 5, onto friction disc 13. Friction disc 13 and the fixed stop ring 17 together act as comminutors. Driven by centrifugal force, the particles are crushed between stop ring 17 and the rapidly rotating friction disc 13. The crushing is promoted by the fact that the omnipresent water softens the particles. Moreover, the particles are fed by gravity through the annular gap between stop ring 17 and friction disc 13 onto the surface area of centrifuge 15, i.e. to micro filter 14, and are there conveyed along the surface area as far as its upper edge 23. After leaving centrifuge 15 via its upper edge 23, the particles fall, again by gravity, onto discharge surface 20. On discharge surface 20 they are conveyed past the outside of centrifuge 15 into pump well 21. There they are fed by the lye pump to a drain system after passing through trap 19.

The rinsing liquor which conveys the dirt particles follows partially the same route as these particles. Having reached centrifuge 15, however, the liquor is forced by gravity against the surface area of centrifuge 15 designed as a micro filter 14. Since the surface area is formed by a micro filter 14, the water is here separated from the particles and forced through micro filter 14. If it passes through micro filter 14 above discharge surface 20, it follows the route of the dirt particles just described. However, if it is forced through the micro filter underneath discharge surface 20, the circulating pump sucks in the filtered water and returns it to the rinsing circuit.

During operation an inclined water level W is obtained inside pump head 7 due to the power of the circulating pump, which level is only shown in principle in FIG. 1. It ranges from a high level on the side of the lye pump to a low level on the side of the circulating pump. In fact this water level overlaps a parabolic shaped level which is formed due to the fact that centrifuge 15 causes the water in pump head 7 to rotate vigorously, hence drifting apart in a funnel shape. The centrifuge is generally operated both when the lye pump is switched on and when the circulating pump is switched on, but can also be operated when only the circulating pump or only the lye pump is switched on. It is also possible for the centrifuge to perform its function not continuously, but only in alternate operation, i.e. between "on/not on", e.g. according to the degree of contamination of the rinsing liquor.

The invention claimed is:

1. A dishwasher comprising:

a washing container having item retaining devices for retaining items to be washed with a rinsing solution;

a filter system with at least one filter for cleaning the rinsing solution;

a comminutor for comminuting material entrained with the rinsing solution such that the comminuted material is reduced in size by the comminutor, the rinsing solution following a flow path in which the rinsing solution enters an upstream side of the comminutor, passes through the comminutor with material of a predetermined size that is entrained with the rinsing solution, such entrained material of a predetermined size being reduced in size by the comminutor, and exits the comminutor on a downstream side thereof to continue flowing downstream of the comminutor;

a lye pump;

a circulating pump; and a micro filter arranged in the path of flow downstream of the comminutor of the rinsing solution, wherein the micro filter forms, at least in part, a surface area of a centrifuge for centrifuging the rinsing solution, wherein the surface area of the centrifuge widens conically towards an ejection opening, and all flow paths of the rinsing solution to the circulating pump go through the portion of the micro filter that forms the surface area of the centrifuge.

2. The dishwasher according to claim 1, wherein the at least one filter comprises a coarse filter arranged in the path of flow upstream of the comminutor.

3. The dishwasher according to claim 2, wherein the comminutor is arranged in the path of flow between the coarse filter and the centrifuge.

4. The dishwasher according to claim 3, wherein the coarse filter, the centrifuge and the comminutor are arranged at a selected one of an orientation above each other and an orientation coaxial to each other.

5. The dishwasher according to according to claim 1, wherein the ejection opening and a feed opening of the centrifuge at least partially overlap.

6. The dishwasher according to claim 1, wherein a frictional surface is formed on the bottom surface of the centrifuge opposite the ejection opening, which frictional surface, together with a stop ring, serves as the comminutor.

7. The dishwasher according to claim 2, wherein a fine filter is arranged in the path of flow in front of the centrifuge, bypassing the comminutor and the coarse filter.

8. The dishwasher according to claim 1, wherein a pump well is formed upstream of the lye pump, which pump well is separated from the feed of the lye pump by a trap.

9. The dishwasher according to claim 1, wherein a suction cap is arranged upstream of the circulating pump in the pump well, which cap prevents the formation of a flow funnel in the sucked in rinsing solution.

10. A method for cleaning rinsing solution in a filter system of a dishwasher, the method comprising:

flowing a rinsing solution in a rinsing circuit in a washing container having item retaining devices for retaining items to be washed;

conducting rinsing solution out of the washing container and through a coarse filter and a micro filter, whereupon material below a given maximum size entrained in the rinsing solution remains with the rinsing solution as the rinsing solution flows through the coarse filter;

returning rinsing solution that has passed through the micro filter to the rinsing circuit, such that all flow paths of the rinsing solution that is returned to the rinsing circuit pass through the micro filter; and comminuting by a comminutor material entrained with the rinsing solution that had remained entrained with the rinsing solution after the rinsing solution had passed through the coarse filter such that the comminuted material is reduced in size by the comminutor; and removing such comminuted material via a lye pump.

11. The method according to claim 10, wherein the comminuted material is centrifuged and then removed.

12. The method according to claim 10, wherein rinsing solution is cleaned through a fine filter and is filtered by the micro filter and/or centrifuged without being comminuted.

13. The method according to claim 10, wherein particles are retained by a trap in a suction connection of the lye pump.

14. The method of claim 10, wherein the micro filter forms, at least in part, a surface area of a centrifuge for centrifuging the rinsing solution, wherein the surface area of the centrifuge widens conically towards an ejection opening.

15. A method for cleaning rinsing solution in a filter system of a dishwasher, the method comprising:

flowing a rinsing solution in a washing container having item retaining devices for retaining items to be washed;

conducting the rinsing solution out of the washing container and through a coarse filter and a fine filter, whereupon material below a given maximum size entrained in the rinsing solution remains with the rinsing solution as the rinsing solution flows through the coarse filter;

comminuting in a comminutor material entrained with the rinsing solution that had remained entrained with the rinsing solution after the rinsing solution had passed through the coarse filter such that the comminuted material is reduced in size by the comminutor; and after the step of comminuting the material entrained with the rinsing solution, recirculating the rinsing solution to the washing container such that the rinsing solution is filtered via a micro filter and all flow paths of the rinsing solution that is recirculated to the washing container flow through the micro filter.

16. The method according to claim 15, wherein comminuted remains from the comminuting step are centrifuged in a rotating micro filter designed as a centrifuge, then removed by a lye pump.

17. The method according to claim 15, wherein comminuted remains from the comminuting step are comminuted by a rotating friction disc and a fixed stop ring.

18. The method of claim 15, wherein the micro filter forms, at least in part, a surface area of a centrifuge for centrifuging the rinsing solution, wherein the surface area of the centrifuge widens conically towards an ejection opening.

* * * * *